US009114457B2

(12) United States Patent
Nabawy et al.

(10) Patent No.: US 9,114,457 B2
(45) Date of Patent: Aug. 25, 2015

(54) FOAM MATERIAL AND METHOD FOR THE PREPARATION THEREOF

(71) Applicant: King Saud University, Riyadh (SA)

(72) Inventors: Ahmed Mohammed Nabawy, Riyadh (SA); Abdelrazek Khalil, Riyadh (SA); Abdulrahman M. Al-Ahmari, Riyadh (SA)

(73) Assignee: King Saud University, Riyadh (SA)

( * ) Notice: Subject to any disclaimer, the term of this patent is extended or adjusted under 35 U.S.C. 154(b) by 137 days.

(21) Appl. No.: 14/020,943

(22) Filed: Sep. 9, 2013

(65) Prior Publication Data

US 2014/0106181 A1 Apr. 17, 2014

(30) Foreign Application Priority Data

Oct. 15, 2012 (EP) ..... 12188539

(51) Int. Cl.

| | |
|---|---|
| ***C22C 21/00*** | (2006.01) |
| ***C22C 32/00*** | (2006.01) |
| ***B22F 7/00*** | (2006.01) |
| ***B22F 3/00*** | (2006.01) |
| ***B22F 3/11*** | (2006.01) |

(52) U.S. Cl.

CPC ..... *B22F 7/002* (2013.01); *B22F 3/1137* (2013.01); *C22C 21/00* (2013.01); *C22C 32/0063* (2013.01); *C22C 32/00* (2013.01); *Y10T 428/12479* (2015.01)

(58) Field of Classification Search

CPC ..... B22F 7/002; B22F 3/1137; C22C 21/00; C22C 32/00

See application file for complete search history.

(56) References Cited

U.S. PATENT DOCUMENTS

| | | | | |
|---|---|---|---|---|
| 6,087,024 | A * | 7/2000 | Whinnery et al. | 428/613 |
| 7,258,770 | B2 * | 8/2007 | Weyl et al. | 204/424 |
| 2003/0005793 | A1 | 1/2003 | Dobesberger et al. | |
| 2010/0021758 | A1 | 1/2010 | Mortensen et al. | |
| 2011/0020662 | A1 * | 1/2011 | Okamoto et al. | 428/566 |
| 2014/0044951 | A1 * | 2/2014 | Beals et al. | 428/221 |

FOREIGN PATENT DOCUMENTS

JP 2008274402 A * 11/2008

OTHER PUBLICATIONS

"Compressive (Crushing) Strength of Alumina (Aluminum Oxide, Al2O3)." Alumina (Aluminum Oxide, Al2O3) Material Properties. MakeItFrom, 2009. Web. Mar. 16, 2015. <http://www.makeitfrom.com/material-properties/Alumina-Aluminum-Oxide-Al2O3/>.*

Liu, H. JP 2008274402 A. Machine translation. Nov. 2008.*

(Continued)

*Primary Examiner* — George Wyszomierski
*Assistant Examiner* — Tima M McGuthry Banks
(74) *Attorney, Agent, or Firm* — Renner, Otto, Boisselle & Sklar, LLP

(57) ABSTRACT

The present invention relates to a method for preparing a foam material, comprising the steps: a) providing a powder material, comprising at least one metal powder and optionally at least one ceramic powder; b) providing a perform comprising a particulate material; c) mixing the powder material in the preform; and d) removing the particulate material by exposing the mixture obtained in step c) to the solvent, wherein the particulate material is soluble in the solvent and to a foam material obtainable by said method.

12 Claims, 9 Drawing Sheets

(56) References Cited

OTHER PUBLICATIONS

Yang et al.; "Compressive behaviour of open cell Al-Al2 03 composite foams fabricated by sintering and dissolution process"; Materials Science and Technology 2007, vol. 23, No. 4, pp. 502-504.

Goodall et al.; "Spherical pore replicated microcellular aluminium: Processing and influence on properties"; Materials Science and Engineering A 465 (2007), pp. 124-135.

Conde et al.; "Replication Processing of Highly Porous Materials"; Advanced Engineering Materials 2006, 8, No. 9, pp. 795-803.

* cited by examiner

FOAM MATERIAL AND METHOD FOR THE PREPARATION THEREOF

The present application is a U.S. Application based on and claiming benefit under 35 U.S.C. §119 of European Application No. 12188539.6, filed 15 Oct. 2012, the entirety of which is hereby incorporated herein by reference.

TECHNICAL FIELD

The present invention relates to a foam material, in particular a foam metal or metal/ceramic hybrid material, and a method for the preparation thereof.

BACKGROUND

Porous materials have been widely used for daily requirements and modern industries from long ago because they can be utilized in important applications, such as filtering and purifications systems, acoustic and thermal insulation, building constructions, transportation, biomaterials, communications, aeronautical applications, etc. These special materials possess unique combinations of properties such as lightweight and excellent sound absorption due to the existence of a large number of pores that can lead to attenuation of sounds, high impact energy absorption arising from their large strains under relative low stresses, and high damping originating from the vibration of cell walls and the friction of cracks, as well as high gas permeability, etc.

According to the connections of pores, porous materials can be categorized as closed-cell and open-cell. In most cases, the applications such as filtration, separation, and sound or energy absorption require open-cell morphologies. Thus, porous metals with open-cell morphologies have wider applications in functional structures.

Many methods are currently recognized in the art for manufacturing metallic foams. According to one method, related to self-expanding foams, the liquid metal is mixed with a blowing agent which in turn generates gas bubbles throughout the metal matrix resulting in the foaming morphology, (US 2004/0079198 A1). In this method, it is difficult to get uniform foam structures due to inability to evolve blowing gas and disperse it throughout the matrix at optimum rate.

In order to avoid the non-uniform structure of produced foam, US 2010/0098968 A1 proposes a new fabrication method in which a metal foam structure is fabricated by filling the spaces around the readymade hollow metallic spheres with a metal matrix-forming material. Thus, the produced foam will have a symmetric morphology. The main difficulty in this technique is limited pore size range.

Manufacturing method of a metal foam in which a self-supporting, net-shaped porous preform is infiltrated by molten metal or impregnated with the matrix metal, wicking process, has been proposed in a number of patents. U.S. Pat. No. 5,679,041 A proposes a manufacturing technique in which a durable perform, composed of self-supporting fugitive polymeric particles without separate interparticle bonding, is filled by a molten metal. Prior to filling the preform with the metal, the polymer is evaporated giving a network of capillaries of the original polymeric foam morphology.

US 2008/314 738 discloses open-cell metal foam prepared by using a fugitive, open-cell, polymeric foam substrate consisting of a plurality of ligaments interconnected by nodes which together provide a three dimensional network of interstitial cells. The three dimensional network of the polymeric foam substrate is impregnated with a slurry of the filler particles suspended in aqueous solution media. The interstitial cells are filled with about 5% to 90% by volume particles. Thus, upon drying about 30% to 95% by volume void space generates between particles for subsequently molten filling. Producing, stable and durable preform using this method is quite difficult.

U.S. Pat. No. 3,694,325, relates to formation of a metal foam by electrodepositing a layer of the metal onto a fugitive foam substrate (polyurethane) which in turn is burned off, leaving a hollow metal network. This method can not be applied for the large dimension scale of products.

SUMMARY

It is an object of the present invention to provide a porous, foam material which overcomes the drawbacks of the prior art, in particular a foam material which has superior compressive strength and energy absorption properties. Moreover, a foam material shall be provided having high thermal conductivity and simultaneously almost no thermal extension. Further, a foam material shall be provided that can be prepared by high feasibility, reliability and applicability with low production costs.

It is an particular object of the invention to provide a foam material which can be prepared at low costs under mild conditions, in the absence of toxic materials which has properties, such as porosity, pore shape, pore size and homogeneity of pore distribution etc. which can be varied in a range significantly increased in comparison to the prior art.

This object has been achieved by a method for preparing a foam material, comprising the steps: a) providing a powder material, comprising at least one metal powder and optionally at least one ceramic powder; b) providing a preform comprising a particulate material; c) mixing the powder material and the preform; and d) removing the particulate material by exposing the mixture obtained in step c) to a solvent, wherein the particulate material is soluble in the solvent.

Preferably, the metal is a non-ferrous metal, more preferably Al, Mg or Zn, most preferably Al.

More preferably, the ceramic is SiC, TiC, $Al_2O_3$, AlN, $TiB_2$, TiN or ZrC, preferably SiC.

In a further preferred embodiment, mixing is carried out by applying an electromagnetic force and/or a Lorentz force and/or by spark plasma sintering.

In one preferred embodiment, the particulate material is a water soluble particulate material, more preferably is a water soluble inorganic salt, most preferably is NaCl and/or KCl, and the solvent is water.

In another preferred embodiment, the foam material is an open-cell foam.

Preferably, the powder material comprises 1-70 wt.-% of the at least one ceramic powder, most preferably 1-50 wt.-%.

Even preferred, mixing is carried out in a temperature range from 500-1,000° C., preferably from 600-700° C.

The object is also achieved by a foam material obtainable by the inventive method.

It was surprisingly found that a foam material can be prepared by the inventive method having properties superior over comparable materials known in the art, in particular having superior compressive strengths and increased energy absorbance.

A foam material, in terms of the present invention shall be understood as a substance that is formed by trapping pockets of gas in a solid. This kind of solid foams can, in general, be divided into closed-cell foams and open-cell foams. In a closed-cell foam, the gas forms discrete pockets, each completely surrounded by the solid material. In an open-cell foam, the gas pockets are, at least partially, connected with each other.

A powder in terms of the present invention shall be understood as a solid being present in form of a variety of small particulates. Accordingly, a powder can be obtained, for example, from a dry solid by careful grinding. The powders used in the inventive method, i.e. the metal powder and the ceramic powder as well as the particulate material, which can also be considered to be a powder, consists preferably of microparticles and/or nanoparticles, meaning particles having a diameter in at least one direction in space of 1 to below 1.000 μm respectively 1 to below 1.000 nm.

In general, the term nano in terms of the present invention relates to a size range from 1 to 100 nm which is the size range in which the properties of an object of the respective size are affected by quantum mechanical effects.

For applying an electromagnetic force and/or a Lorentz force in the mixing step, according to a preferred embodiment of the inventive process, each means for applying a electromagnetic/Lorentz force general known in the art can be used. Particularly preferred, means for applying a force are a high-frequency induction heated apparatus which, preferably, in addition causes heating of the powder material and the preform to ensure careful mixing.

Removing in terms of the present invention means removing of at least parts of the particulate material. Preferably, at least 90% of the particulate material are removed during the removing step d). The removing in step d) by exposing the mixture obtained in step c) to a solvent can be assisted by heating, using a pre-heated solvent, by ultrasonic treatment etc.

Mixing in step c) of the inventive method shall be understood as infiltrating of the powder material into the perform to provide substantially homogeneous distribution of the metal and/or ceramic material around the particulate material. In this way, a homogeneous, stable foam material can be obtained by the inventive method.

By using an assisting electromagnetic and/or Lorentz force in the mixing step, the possibility is provided to prepare foam materials comprising particularly high amounts of ceramic in addition to the metal, for example in a range from 1 to 50 wt.-% or more and to further enable a homogenous distribution of the ceramic and the metal in the foam material.

Preferably, the mixture of step a) can be provided from respective metal and ceramic materials by grinding, in particular by using ball milling technique.

The electromagnetic force can be defined as volume force, named Lorentz force. According to Faraday's law and right hand rule, the Lorentz force leads to a high stirring energy in the material to be mixed.

The invention will now be described in more detail by the examples with reference to the accompanying drawings with the intention to exemplify the invention. The examples, however, are not intended to have any limiting effect on the subject matter of the claims or on the scope of protection.

DETAILED DESCRIPTION

Examples

Materials:

Pure Aluminum powder (99.7%) with an average particle size 10 μm

Pure Magnesium powder (99.7%) with an average particle size of 10 μm

Figure 1:
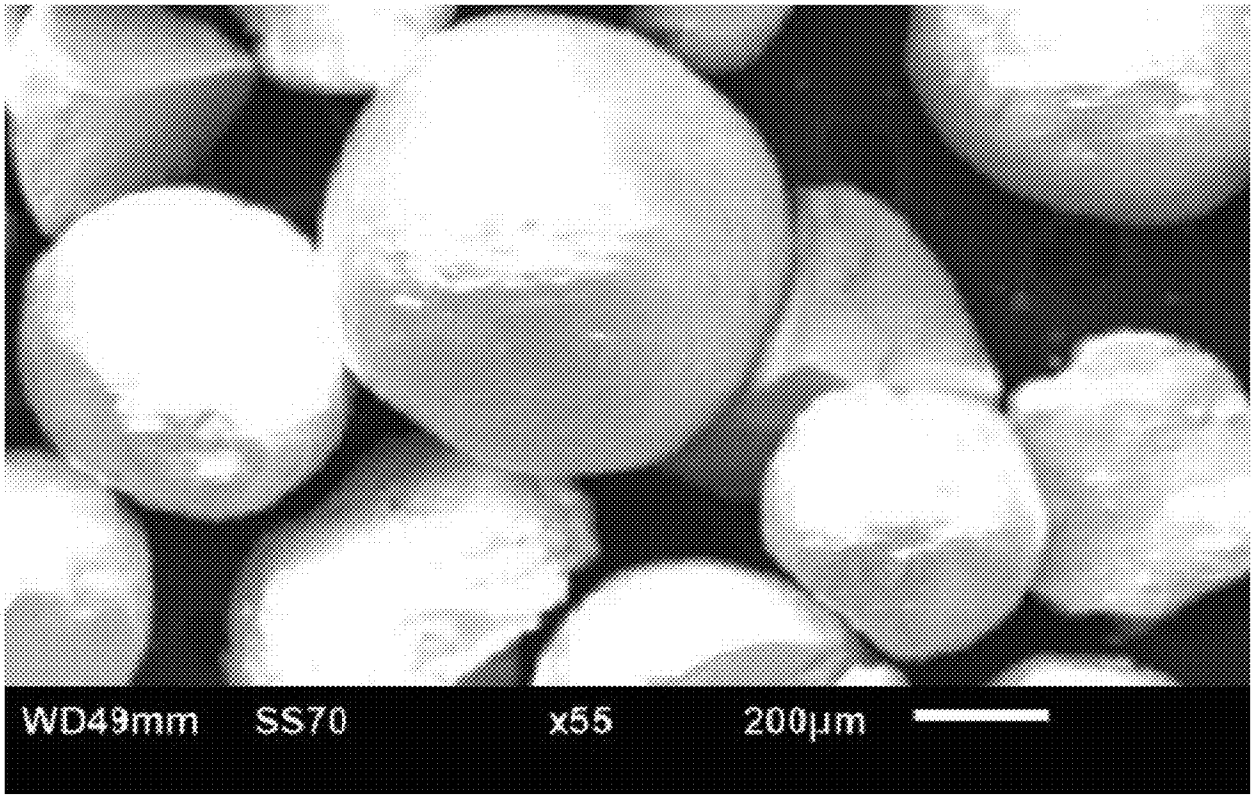
FIG. 1. shows a secondary electron image of sodium chloride particulate material preform.

Sodium chloride with average particle size 35 μm (see FIG. 1)

Nano SiC particles with an average size of 50 nm (ceramic powder)

1. Preparation of a Powder Material

The metal powders are mixed with a designated amount of the nano ceramic powder equate 10 wt % of composite using ball milling technique. Zirconia balls having 6 mm diameter are added in a weight ratio of 20/1 with the mixture in order to obtain a high degree of homogeneity. The milling is carried out for 6 hr at milling speed of 100 rpm. In the ball milling process, the main mechanisms are the repeated welding, fracture, and re-welding of the mixed powders of ceramics and metals. The ball milling technique is conducted in the current invention as mixing process providing a suitable degree of homogeneity.

2. Preparation of a Sodium Chloride Preform

Spherical particulates of sodium chloride (particulate material) with an average diameter of 350 μm are pressed in the form of cylindrical preform with 20 mm diameter and 30 mm height. The sodium chloride particulates have a spherical morphology with a small variation in diameter measurements and are used in order to obtain perfect foaming morphology with homogeneous pores size. The spherical morphology and size homogeneity of sodium chloride particulates enhance the capillary force during the infiltration process. The sodium chloride preform is placed in a hollow cylindrical graphite die above an enough amount of the Al/10 wt % SiC composite powder. This charge (NaCl preform above composite powder) is hold vertically in the hollow cylindrical graphite die by means of two cylindrical graphite punchers from both sides top and bottom.

3. Infiltration Process (Mixing the Powder Material and the Perform)

In this stage, the sodium chloride preform is infiltrated under heating and stirring applied by means of a high-frequency induction heating apparatus (HFIH). A graphite die assembly is placed in the core of a high induction coil at the heating focal point. The process is started by passing of extremely high alternating current through the coil providing an intense magnetic field. The magnetic field in turn is applied through the electrically conducting graphite die and, through the conducted sample. Thus, the graphite die also acts as a heating source, and the sample is heated from both the outside and inside. Once the temperature reaches 640° C., the aluminum powder is melted and a viscous slurry of Al/10 wt % SiC is formed. The heating is applied under vacuum of $1\times10^{-3}$ Torr and at high heating rate of 700° C./min.

Figure 2:
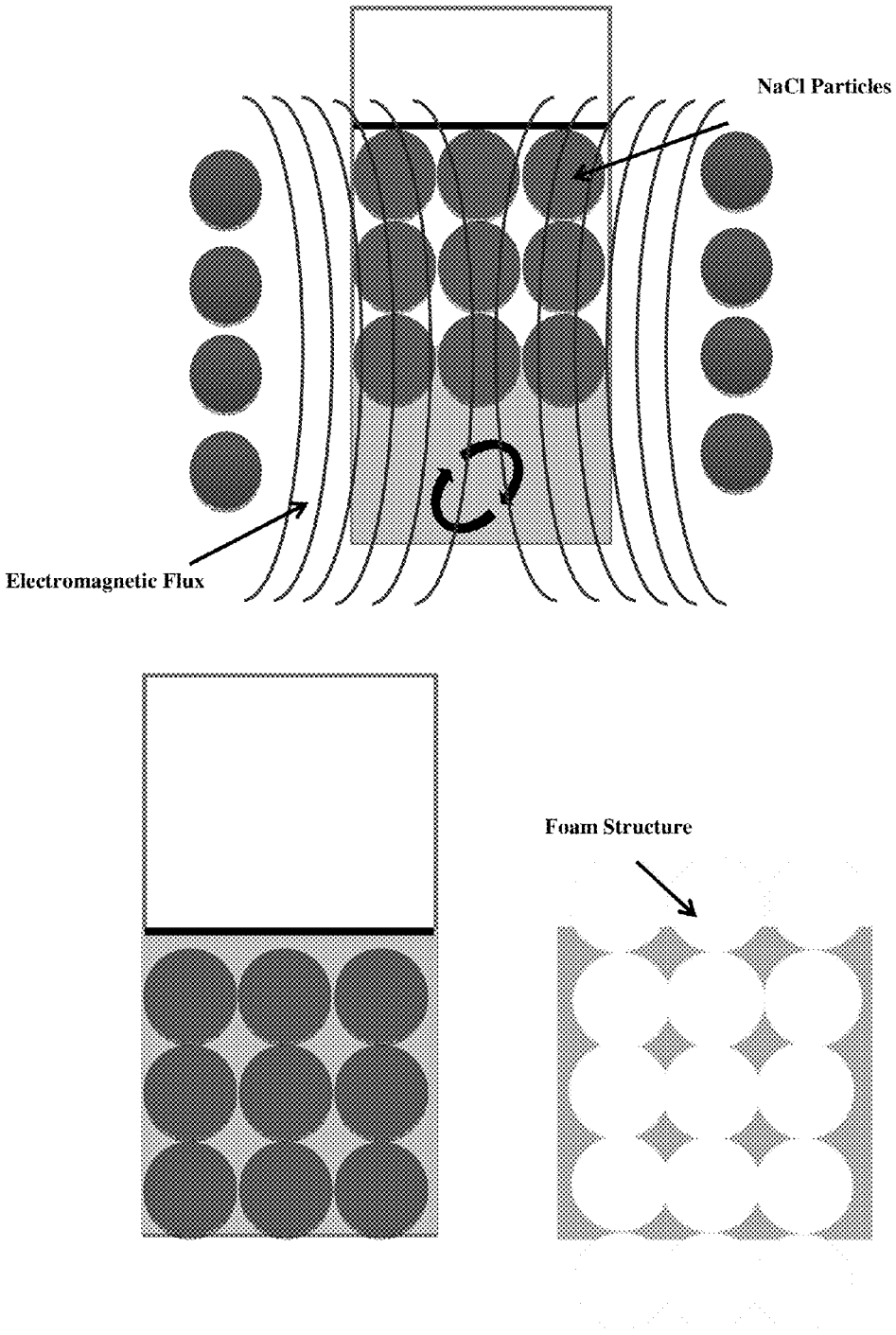
FIG. 2 shows schematic sketch of the infiltrating (mixing) process under the action of electromagnetic force.

In the presence of the intrinsic magnetic field, a strong electromagnetic force will be generated around the coil passing through the sample. The electromagnetic force can be defined as volume force, named Lorentz force. According to Faraday's law and right hand rule, the Lorentz force leads to a high stirring energy on Al/SiC slurry. During the development of stirring action of Lorentz force, the slurry flow type change from laminar to turbulence causes an increase in the slurry pressure under the sodium chloride preform. This increment in the pressure of Al/SiC slurry leads to perfect infiltration of the slurry into the sodium chloride preform. As the liquid metal infiltrates the preform reaching the top surface of the graphite die, the electromagnetic stirring is turned off and the assembly is left to solidify. FIG. 2 represents the infiltration process procedures under the action of electromagnetic force, (Lorentz force).

4. Removing the Particulate Material

Figure 3:
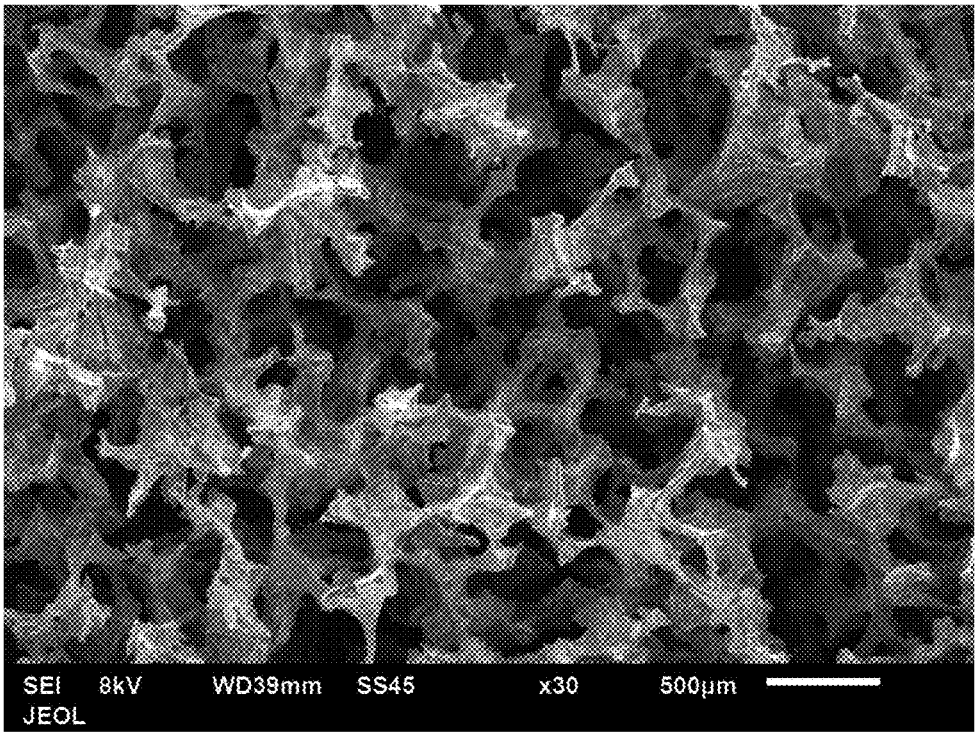
FIG. 3 shows secondary electron image of an inventive foam material of pure aluminum.
Figure 4:
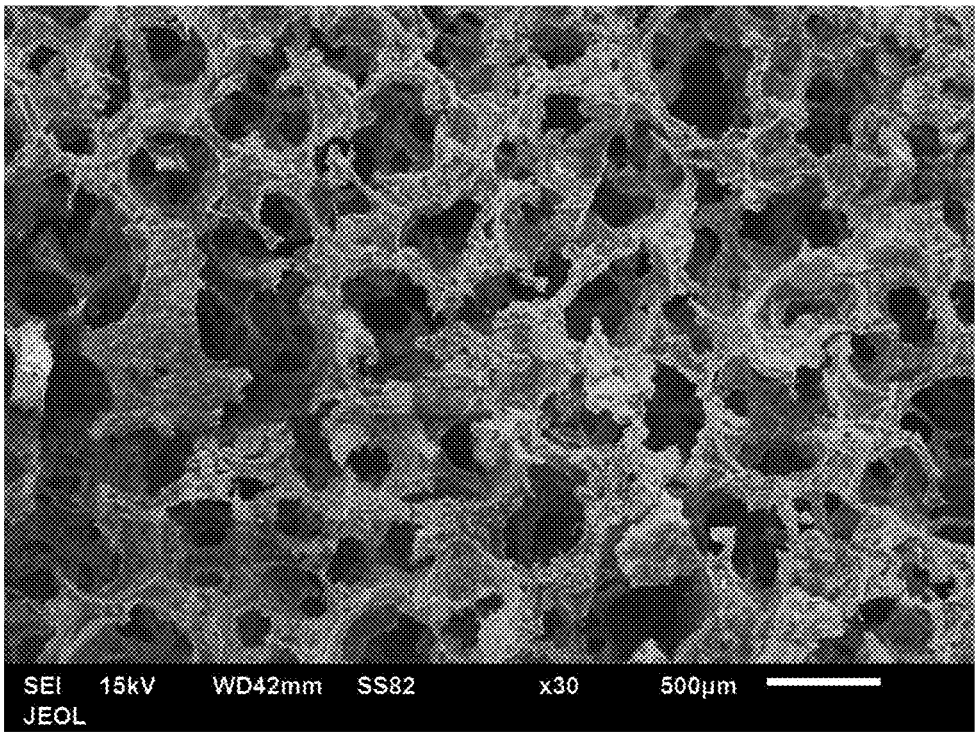
FIG. 4 shows secondary electron image of an inventive foam material of aluminum/10 wt % SiC.
Figure 5:
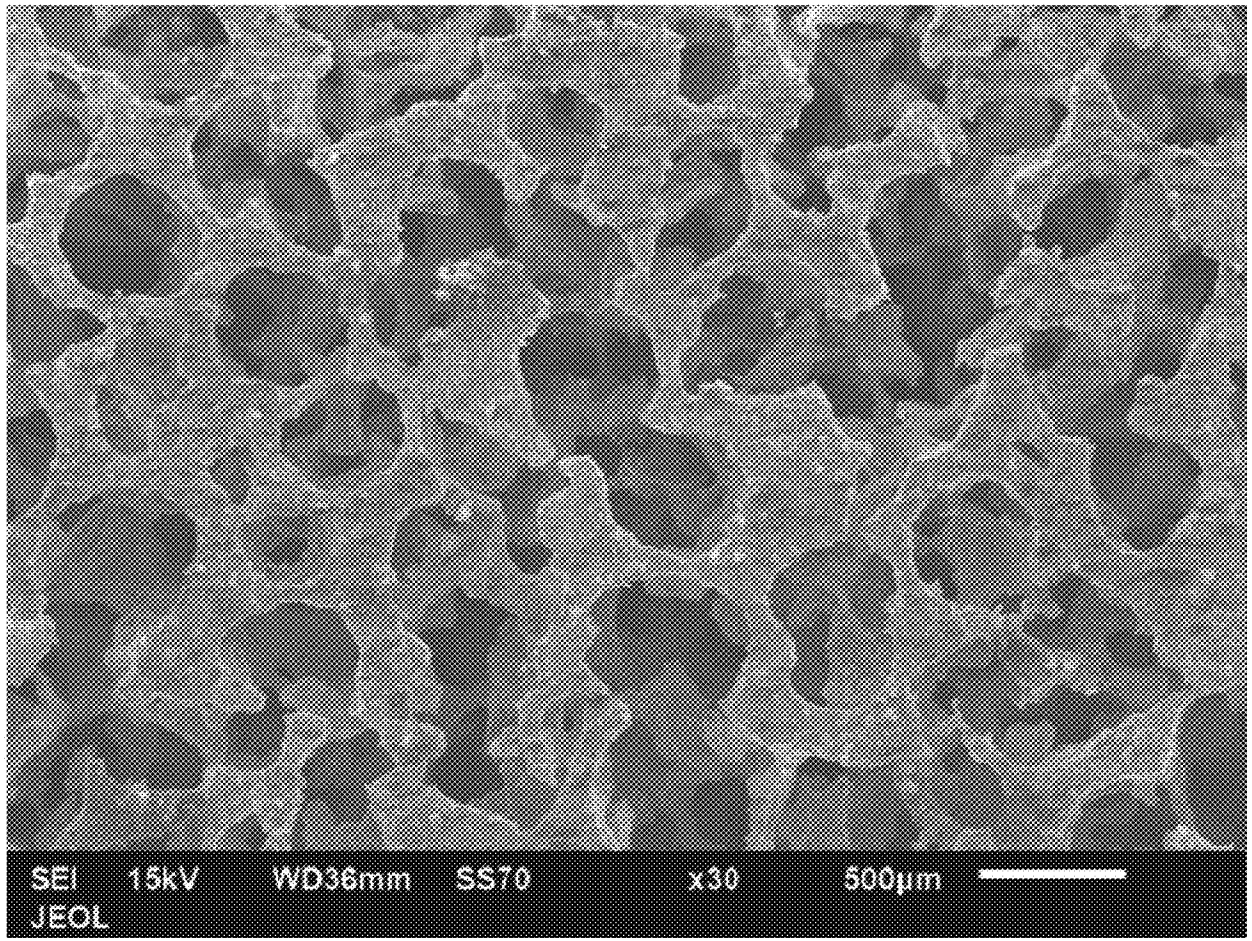
FIG. 5 shows secondary electron image of an inventive foam material of pure magnesium.
Figure 6:
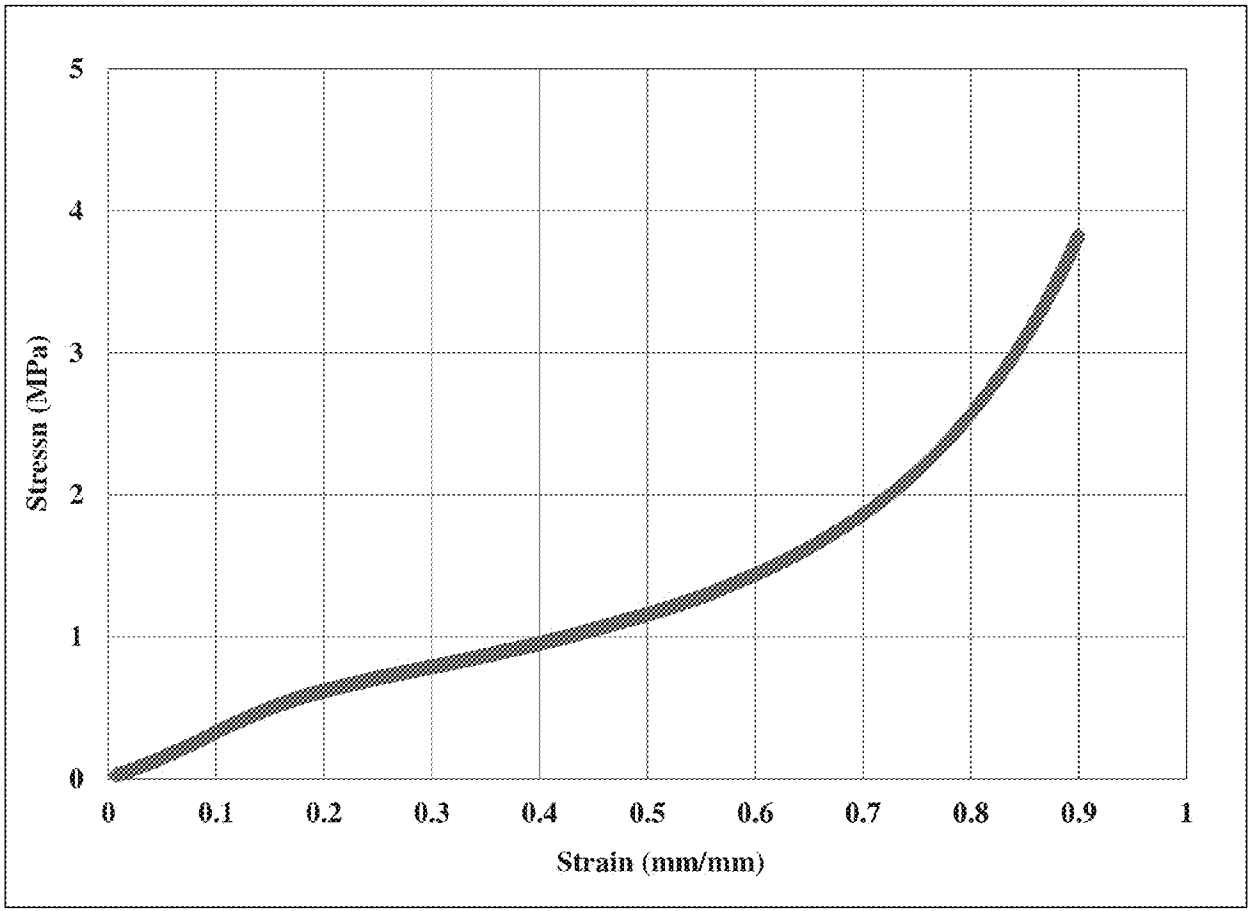
FIG. 6 presents compressive stress-strain curve an inventive foam material of aluminum.
Figure 7:
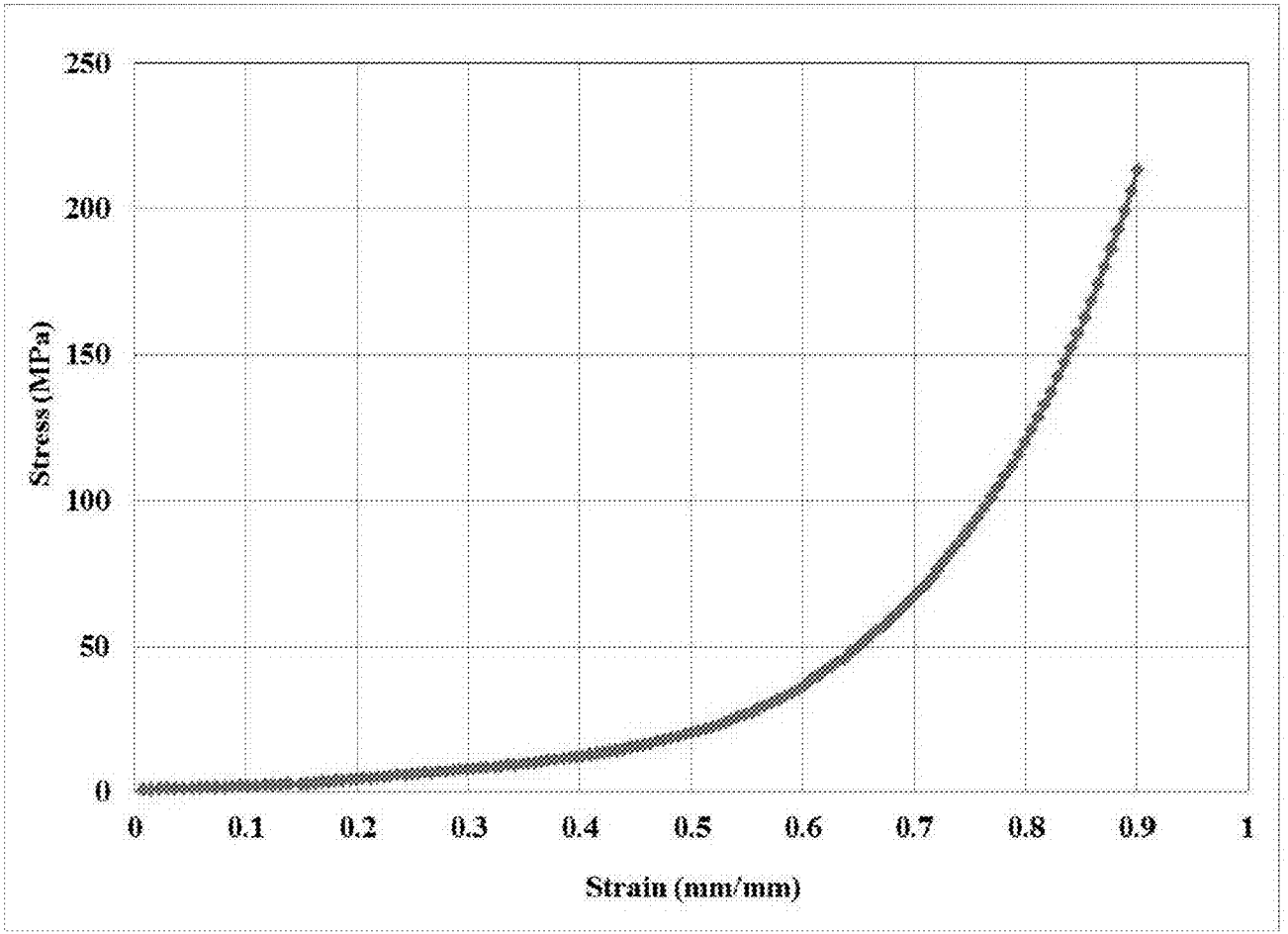
FIG. 7 presents compressive stress-strain curve of an inventive foam material of aluminum/10 wt % SiC.
Figure 8:
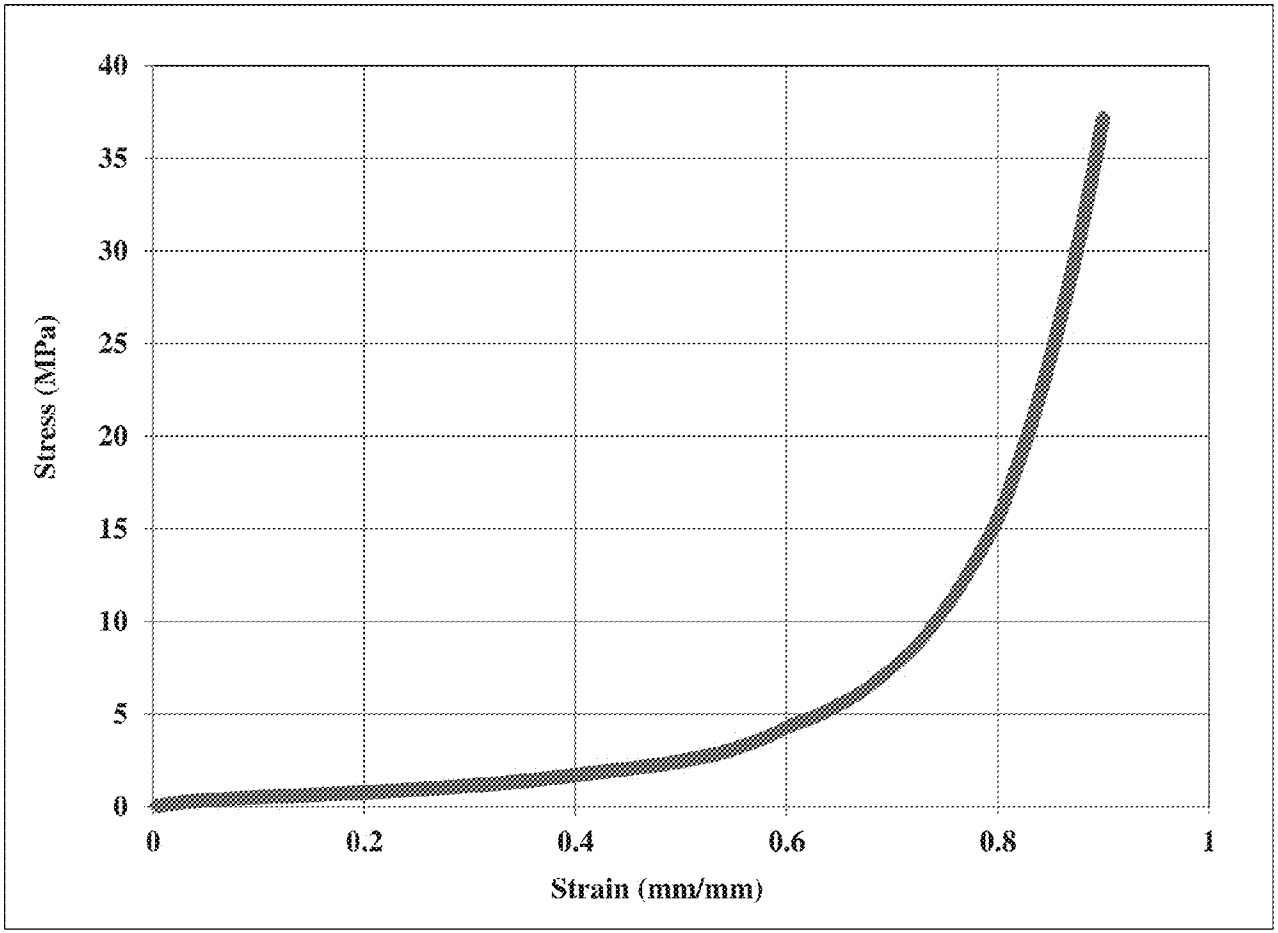
FIG. 8 presents compressive stress-strain curve of an inventive foam material of magnesium.
Figure 9:
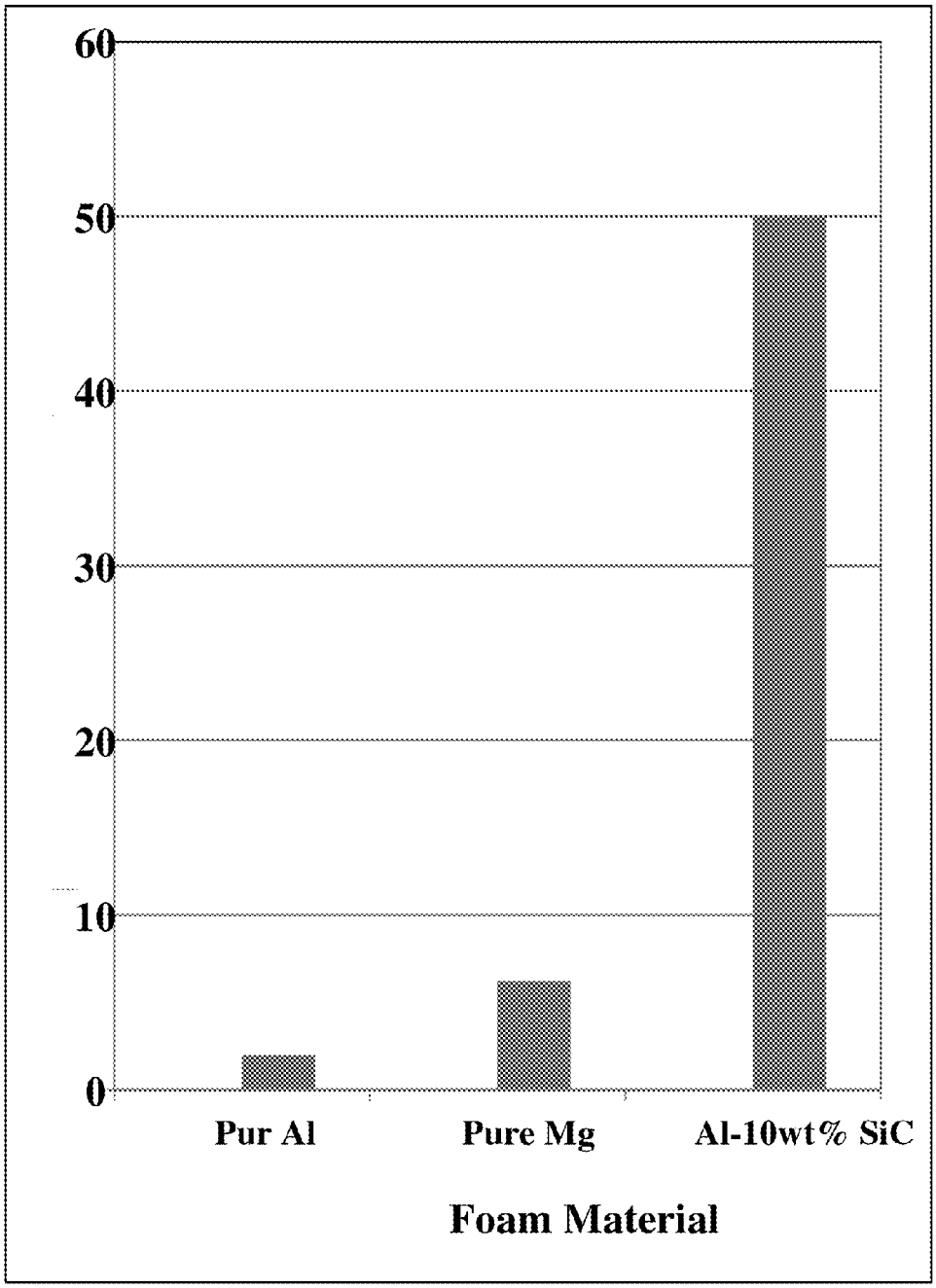
FIG. 9 presents absorbed energy of an inventive foam material of aluminum, aluminum/10 wt % SiC, and magnesium foams.

In the final manufacturing procedure the sodium chloride is dissolved out by soaking the infiltrated preform for 1 hr in a warm water at 40° C. The produced Al/SiC composite foam is obtained with 80% porosity and symmetric pores structure, as shown in FIGS. 3 to 5. In order to assign the improvement degree in the mechanical properties which can be gained by the current manufacturing method, the compression test is conducted at strain rate of $10^{-3}$ $s^{-1}$ for Al/SiC composite, pure aluminum, and pure magnesium materials. From FIGS. 6 to 8, it can be observed that at 0.9 strain the compressive strength of Al/10 wt % SiC composite foam of 213 MPa is significantly higher than that of pure aluminum, 3.8 MPa, and pure magnesium, 37 MPa. The same trend is notified in the absorbed energy results; the Al/SiC achieve absorbed energy of 50 $MJ/m^3$ which equate 25 times and 8 times of absorbed energy of pure aluminum and magnesium, respectively, as shown in FIG. 9. The high strength and absorbed energy of Al/SiC composite can be attributed to the homogenous distribution of nano SiC particulates and to reduction of agglomeration under the intense stirring action of electromagnetic force, Lorentz force.

From the compression testing results shown in FIGS. 6 to 9, the strength and absorbed energy of the Al/SiC nanocomposite foam reflects the superior performance of this material. These distinguished properties indicate the high capability of the disclosed method and material to produce prefect foam structure reinforced by nano ceramic particulates. These results also indicate the high possibility to apply this technique for other nonferrous metals such as Mg, and Zn having low melting point. According to the current invention, the infiltration and incorporation of non-wetting ceramics can be achieved perfectly by the assisting of Lorentz force action.

The features disclosed in the foregoing description, in the claims and/or in the accompanying drawings may, both separately and in any combination thereof, be material for realising the invention in diverse forms thereof.

The invention claimed is:

1. Method for preparing a foam material, comprising the steps:

a) providing a powder material, comprising at least one metal powder and optionally at least one ceramic powder;

b) providing a preform comprising a particulate material;

c) mixing the powder material and the preform; and d) removing the particulate material by exposing the mixture obtained in step c) to a solvent, wherein the particulate material is soluble in the solvent, and wherein the mixing is carried out in a temperature range from 500-1,000° C.

2. Method according to claim 1, wherein the metal is a non-ferrous metal.

3. Method according to claim 2, wherein the ceramic is SiC, TiC, $Al_2O_3$, AlN, $TiB_2$, TiN or ZrC.

4. Method according to claim 2, wherein the metal is Al, Mg or Zn.

5. Method according to claim 1, wherein the ceramic is SiC, TiC, $Al_2O_3$, AlN, $TiB_2$, TiN or ZrC.

6. Method according to claim 1, wherein mixing is carried out by applying one or a combination of two or more of an electromagnetic force, a Lorentz force, or by spark plasma sintering.

7. Method according to claim 1, wherein the particulate material is a water soluble particulate material and the solvent is water.

8. Method according to claim 7, wherein the particulate material is a water soluble inorganic salt.

9. Method according to claim 1, wherein the foam material is an open-cell foam.

10. Method according to claim 1, wherein the powder material comprises 1-70 wt.-% of the at least one ceramic powder.

11. Method according to claim 1, wherein the powder material comprises 1-50 wt.-% of the at least one ceramic powder.

12. Method according to claim 1, wherein mixing is carried out in a temperature range from 600-700° C.

* * * * *